US011248862B2

(12) United States Patent
Frazier et al.

(10) Patent No.: US 11,248,862 B2
(45) Date of Patent: Feb. 15, 2022

(54) AMBIDEXTROUS CHARGING HANDLE

(71) Applicant: Sig Sauer, Inc., Newington, NH (US)

(72) Inventors: Kenneth Samuel Frazier, Derry, NH (US); Bryan Charles Dustin, Strafford, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 17/108,371

(22) Filed: Dec. 1, 2020

(65) Prior Publication Data

US 2021/0172692 A1 Jun. 10, 2021

Related U.S. Application Data

(60) Provisional application No. 62/943,957, filed on Dec. 5, 2019.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72
USPC ..... 89/1.4
See application file for complete search history.

(56) References Cited

U.S. PATENT DOCUMENTS

| | | | |
|---|---|---|---|
| 7,240,600 | B1 | 7/2007 | Bordson |
| 7,832,333 | B2 | 11/2010 | Shi et al. |
| 7,900,546 | B2 | 3/2011 | Bordson |
| 8,104,393 | B2 | 1/2012 | Kincel |
| 8,336,436 | B2 | 12/2012 | Kincel |
| 8,356,537 | B2 | 1/2013 | Kincel |
| 8,960,066 | B2 | 2/2015 | Gomez |
| 9,377,258 | B2 | 6/2016 | Gomez |
| 2016/0298917 | A1 | 10/2016 | Hwang |

*Primary Examiner* — Reginald S Tillman, Jr.
(74) *Attorney, Agent, or Firm* — Finch & Maloney PLLC

(57) ABSTRACT

A charging handle for a firearm includes a longitudinal body with a proximal end portion and a distal end portion. The proximal end portion includes at least one latch lever operable between a first position and a second position, the latch lever including a blocking plate. Moving the handle from the first position to the second position moves the blocking plate from a blocking position to a non-blocking position. The charging handle can be used with a firearm that includes a protrusion extending up from the rear-end portion of the lower receiver or from the recoil assembly. In the blocking position, the blocking plate is aligned with the protrusion and prevents the charging handle from rearward movement. When the blocking plate is in the non-blocking position, the blocking plate clears the protrusion to permit the charging handle to be drawn rearward.

20 Claims, 13 Drawing Sheets

AMBIDEXTROUS CHARGING HANDLE

RELATED APPLICATIONS

This application claims the benefit under 35 U.S.C. § 119(e) of U.S. Provisional Patent Application No. 62/943,957, titled AMBIDEXTROUS CHARGING HANDLE, and filed on Dec. 5, 2019, the contents of which are incorporated herein by reference in its entirety.

TECHNICAL FIELD

The present disclosure generally relates to firearms and firearm accessories.

Specifically, the present disclosure is directed to a charging handle for firearms

BACKGROUND

A charging handle is a device on a firearm which serves multiple functions. In general, the charging handle is an interface between the operator and the bolt, where the operator can use the charging handle to move the bolt within the receiver. One function is to ready the firearm for firing from an unloaded state. For example, after installing a loaded magazine into the magazine well, the operator pulls back on the charging handle to draw the bolt group rearward to "charge" the action. From the rearward position, releasing the charging handle sends the bolt group forward to strip and chamber a round. The charging handle can also be used to manually cycle the action, eject a cartridge or spent shell from the chamber, resolve interruptions to the supply of ammunition to the chamber (e.g., a stoppage, double feed, stovepipe, or misfire), and clear the chamber of any obstructions.

Figure 1:
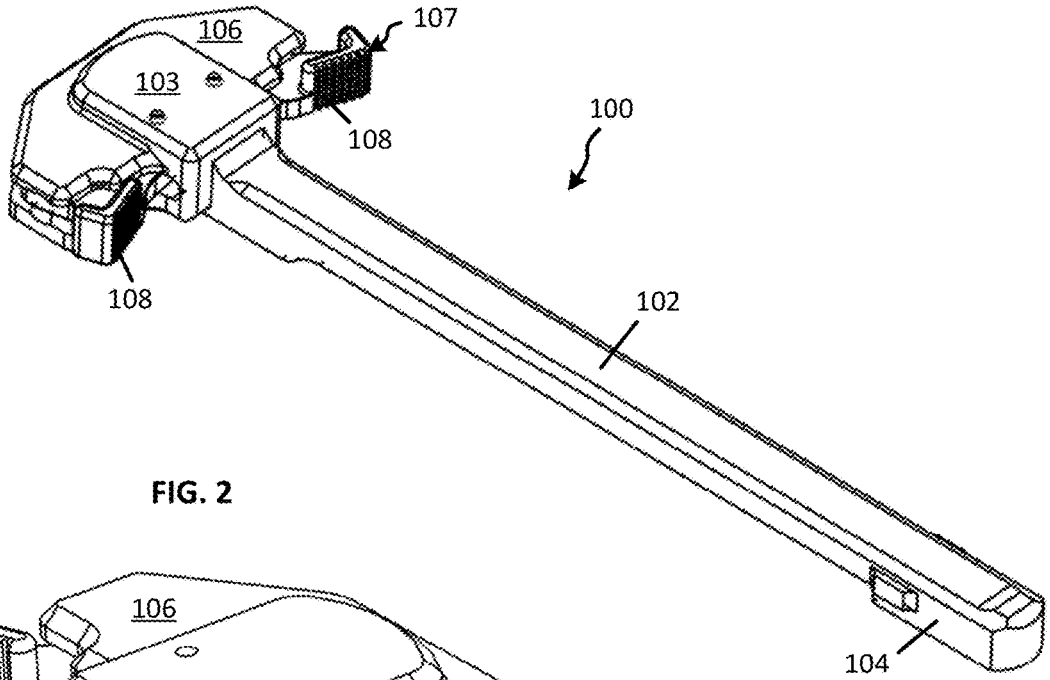
FIG. 1 is a perspective view of a charging handle assembly, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a charging handle assembly for a firearm. The charging handle includes a body extending longitudinally along a central axis, the body having a proximal end portion and a distal end portion. At least one latch lever is attached to the proximal end portion of the body and is operable between a first position and a second position. At least one latch lever includes a blocking plate that extends down from the latch lever. For example, the blocking plate extends down from a rear end portion of the latch lever adjacent the rear end of the handle. The blocking plate can be integral to the latch lever or may be a separate component that is attached, for example, by a bolt or a weld. When the latch lever is in the first position, the blocking plate is in a first lateral position, and when the latch lever is in the second position the blocking plate is displaced to a second lateral position. In one example, the blocking plate aligns with the rifle's central axis when it is in the first lateral position and the blocking plate is to one side of the central axis when it is in the second lateral position. The charging handle may also include a handle portion generally forming a T-shape with the body, where each latch lever can be pulled rearwardly against the handle.

When assembled with a rifle or rifle subassembly, the blocking plate's first and second positions correspond to blocking and non-blocking positions, respectively, in relation to a protrusion or other blocking structure. For example, in the first position, the blocking plate is aligned to contact a protrusion protruding up from the top of the lower receiver or from a spring plate at the proximal end of the recoil assembly. In the second position, the blocking plate is positioned to clear the protrusion to permit moving the charging handle rearwardly along the rifle's receiver, such as to charge the rifle's action. In one example, pulling back on the latch lever(s) moves the blocking plate to the second position (e.g., a non-blocking position) such that the charging handle can be pulled rearwardly past the protrusion. Releasing the lever(s) allows the blocking plate to assume a default position (e.g., the first or blocking position) in which the protrusion is aligned with the path of the blocking plate.

In one embodiment, the protrusion has a distal face that extends transversely with respect to the rifle's central axis. For example, the distal face may be disposed in a position that is at an angle that is less than 45°, less than 30°, less than 20° or less than 10° with respect to a crosswise axis that is perpendicular to the firearm's central axis. In the same and other embodiments, the distal face may be disposed in a position that is at an angle that is greater than 1°, greater than 5°, greater than 10°, or greater than 15° with respect to the crosswise axis. In the latched condition, the distal face of the protrusion can engage the blocking plate on the charging handle and obstruct movement of the charging handle rearwardly unless the blocking plate is moved out of the way of the protrusion by operation of the lever(s). In some embodiments, the protrusion has an angled proximal (rear) surface that deflects the blocking plate to the side when the charging handle moves forward over the protrusion from a rearward position. Thus, the blocking plate and protrusion therefore can prevent movement of the charging handle in one direction (e.g., rearward) while allowing movement in the opposite direction (e.g., forward).

In some embodiments, the charging handle has a single latch lever. In other embodiments, the charging handle can be configured for ambidextrous operation and enables actuation from either a left-hand side or a right-hand side of the firearm. For example, the charging handle includes latch levers on opposite lateral sides of the charging handle body to facilitate operation by both right-handed and left-handed operators. The latch levers can be operatively connected so that operating one lever also operates the other lever. Thus, pulling back on of one or both latch levers moves the blocking plate from the first position (e.g., a blocking position) to the second position (e.g., a non-blocking position).

In another example embodiment, the rifle receiver and the charging handle are constructed so that the blocking plate travels in a channel or similar structure defined along the top of the rear end portion of the lower receiver. In one such embodiment, a protrusion, a catch surface, a wall, or some other structure extends into the channel from a bottom or side wall of the channel. Operation of the latch lever(s) moves the blocking plate out of the path of the protrusion or other blocking structure so that the charging handle can be drawn rearwardly from a latched position. In yet another example, a surface on the lower receiver or recoil assembly defines a catch recess, where operation of the latch lever(s) moves a catch to disengage from the catch recess. In one such embodiment, the catch recess is in a top surface of the lower receiver and operating the lever(s) moves the catch up to a clearance position above the top surface of the catch recess. In another such embodiment, the catch recess is between the rear end portion of the lower receiver and a spring plate on the recoil assembly. Numerous variations and embodiments will be apparent in light of the present disclosure.

General Overview

Existing charging handles generally have a T-shape embodied by a handle connected to and extending sideways from an elongated body. The distal end of the body has a downward overhang constructed to engage a catch surface on the top of the bolt carrier. This engagement between the charging handle and the bolt carrier enables the user to draw the bolt and bolt carrier rearward along the upper receiver. The forward face of the charging handle's body also may have an opening corresponding to the gas key on the bolt carrier such that, when installed in the upper receiver, the gas tube from the barrel extends through the opening to the gas key. The handle portion includes an L-shaped latch lever with a first portion of the L extending laterally along the handle for actuation by the user. The second portion of the L extends forward along the handle body and along the side of the upper receiver. The second portion of the L includes a hook-like catch at its forward end. The catch engages a slot-like recess in the sidewall of the upper receiver when in the latched position. To unlatch the charging handle, the user pulls back on the first portion of the latch lever, thereby pivoting the catch out of engagement with the recess in the upper receiver.

Existing charging handles require machining the side of the upper receiver to create a recess that the catch can engage. The upper receiver is commonly made of aluminum, which is a relatively soft metal. Also, the sidewall of the upper receiver is relatively thin where the catch recess is formed. This means that the depth of recess is limited by the wall thickness and the orientation of the recess is also limited. For example, machining for the recess is performed from the direct left or right side of the receiver and therefore results in an engagement surface oriented perpendicularly to the wall, even though the ideal engagement surface may be one that matches the hook angle (e.g., not perpendicular to the wall). Due to these limitations, the slot-like recess tends to wear over time, eventually resulting in the charging handle losing its hold and allowing the charging handle to reciprocate with the bolt carrier when the rifle is fired.

The present disclosure addresses these and other challenges by providing a charging handle with a latch structure that engages a protrusion on the lower receiver or on the recoil assembly. In accordance with one embodiment, one of the latch levers has a blocking plate that extends downward from the latch lever. In the latched position, the blocking plate contacts or is obstructed by a protrusion on the top of the lower receiver or on part of the recoil assembly, rather than hooking into the side of the upper receiver. Operating the latch handle pivots the blocking plate between a blocking position and a non-blocking position with respect to the protrusion. In its latched position, for example, the distal face of the protrusion is in the path of the blocking plate and therefore prevents moving the charging handle rearward from the forward, latched position. When the user pulls back on the latch lever, the blocking plate moves to the side and out of alignment with the protrusion to allow the charging handle to be drawn rearward. When the charging handle is released forward, an angled proximal face on the protrusion deflects the blocking plate to the side when the blocking plate reaches the protrusion. The handle continues forward to the latched position and a spring returns the blocking plate to the blocking position after passing the protrusion. The charging handle can be configured for single-sided or ambidextrous operation.

In accordance with some embodiments, the distal end portion of the charging handle body directly engages a catch surface on the operating rod (or "op-rod") or an op-rod connector, rather than the bolt carrier. For example, the op-rod connector is coupled to the bolt carrier by a pivot joint at the top of the bolt carrier.

A charging handle as variously described herein can be used with a variety of automatic and semiautomatic firearms, including but not limited to MCX rifles made by Sig Sauer, Inc.; combat rifles, modern sporting rifles, short-barreled rifles, and pistols chambered in 5.56×45 mm, 7.62×51 mm, 7.62×39 mm, and 0.300 BLK; and pistol-caliber carbines based on the AR-15 platform, to name a few examples.

As discussed herein, terms referencing direction, such as upward, downward, vertical, horizontal, top, bottom, left, right, front, back, etc., are used for convenience to describe embodiments of a firearm, its components, or component groups when the firearm is oriented in a traditional firing position with the barrel extending horizontally from the user and the stock abutting the user's shoulder. Embodiments of the present disclosure are not limited by these directional references and it is contemplated that a firearm and its components or component groups discussed in accordance with the present disclosure could be used in any orientation.

Also, it should be noted that, while generally referred to herein as a blocking plate for consistency and ease of understanding the present disclosure, the disclosed charging handle assembly is not limited to that specific terminology or a particular geometry and the blocking plate alternatively can be referred to, for example, as a catch, an arm, a protrusion, a post, or other terms. As will be further appreciated, the particular materials and dimensions of a charging handle assembly configured as described herein may be varied, for example, depending on whether the intended end-use is military, tactical, or civilian in nature. Numerous configurations will be apparent in light of this disclosure.

Example Embodiments

Figure 2:
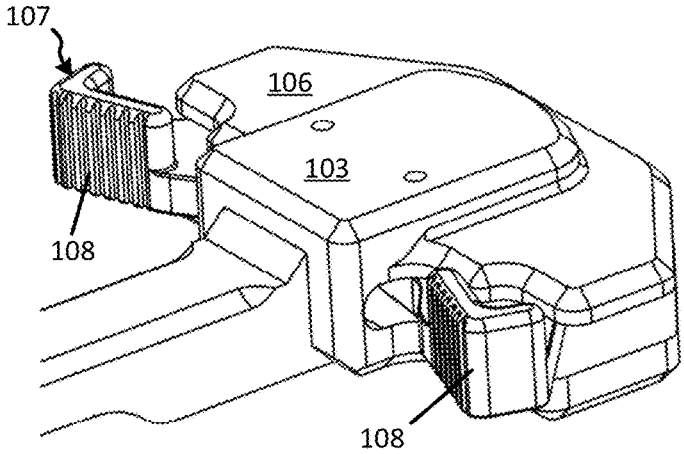
FIG. 2 is a top, front, and side perspective view of a handle portion of the charging handle assembly of FIG. 1, in accordance with an embodiment of the present disclosure.
Figure 3:
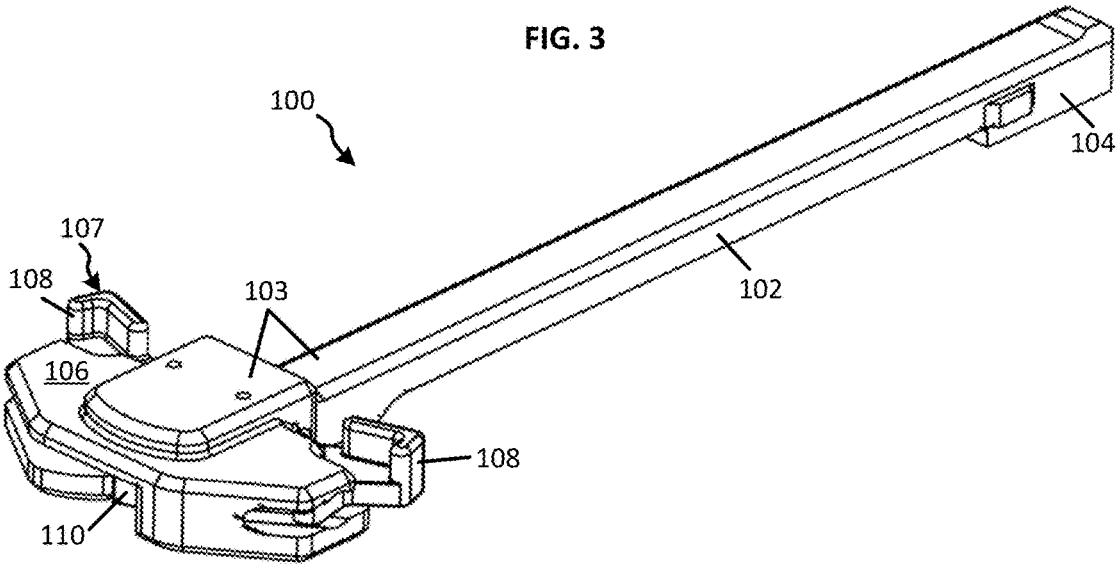
FIG. 3 is a top, side, and rear perspective view of the charging handle assembly of FIG. 1, in accordance with an embodiment of the present disclosure.
Figure 4:
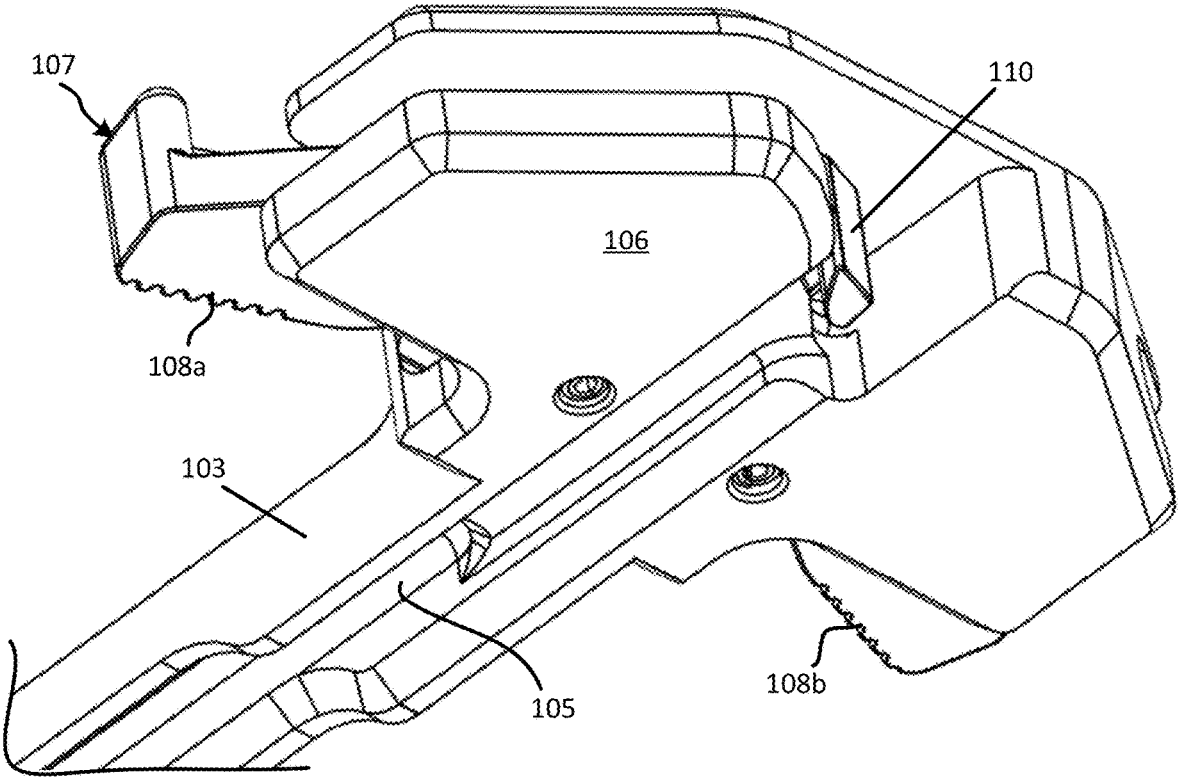
FIG. 4 is a bottom, rear and side perspective view of the handle portion of the charging handle assembly of FIG. 1, in accordance with an embodiment of the present disclosure.
Figure 5:
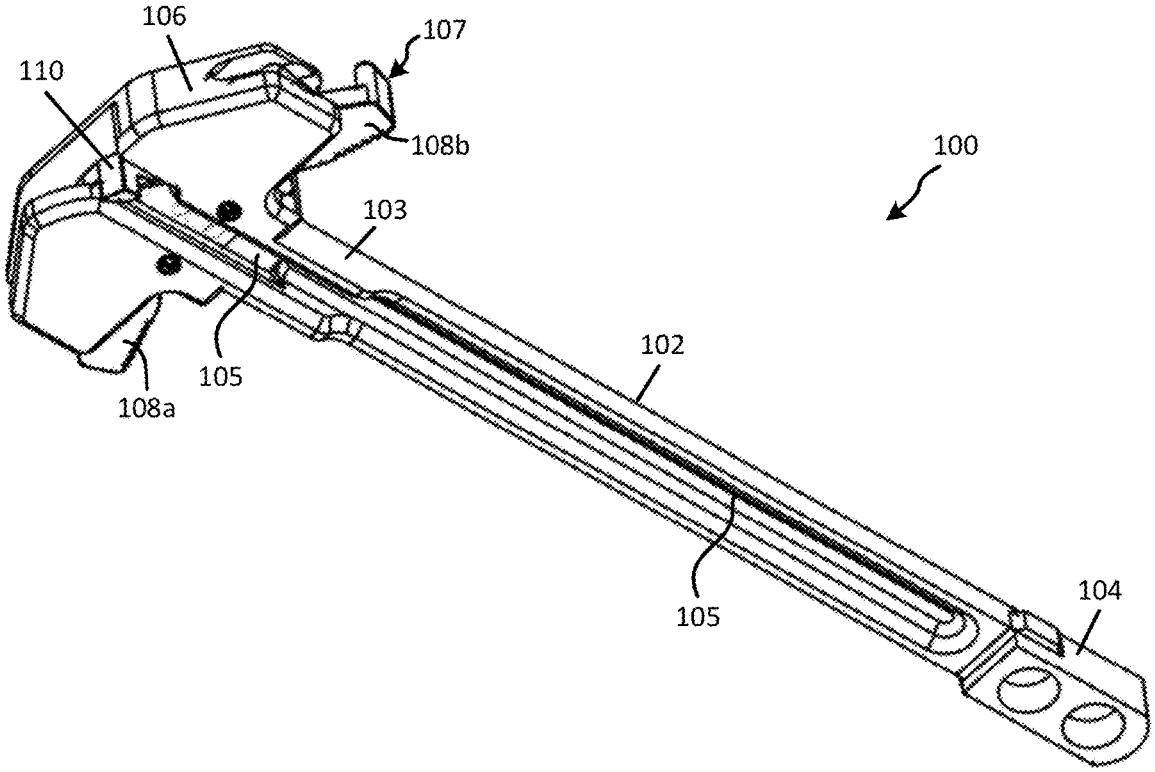
FIG. 5 is a bottom perspective view of the charging handle assembly of FIG. 1, in accordance with an embodiment of the present disclosure.

FIGS. 1-5 illustrate views of a charging handle 100 (or charging handle assembly 100), in accordance with an embodiment of the present disclosure. FIG. 1 is a top and front perspective view, FIG. 2 is a perspective view showing the top, front, and side of the handle 106, FIG. 3 is a top and rear perspective view, FIG. 4 is a bottom perspective view showing the handle 106 and latch mechanism, and FIG. 5 is a bottom perspective view.

The charging handle 100 includes an elongated body 102 with a distal end portion 104 and a proximal end portion 103. The body 102 is sized and configured to reciprocate within part of the upper receiver 96 of a firearm to charge the action. A handle 106 on the proximal end portion 103 extends transversely to the body 102 to generally define a T-shape that can be grasped by the user. In some embodiments, the handle 106 houses portions of a latch assembly 107 including the latch 110 and at least one latch lever 108. In this example, the latch assembly 107 is configured for ambidextrous operation and has latch levers 108 on opposite lateral sides of the handle 106 that pivot between first and second positions. The user can operate one or both latch levers 108 to move the latch 110 between latched and unlatched positions.

The handle 106 can be integrally formed with the body 102 or it can be a separate component that is attached to the body 102. For example, the body 102 and handle 106 are a single component made of metal. In another example, the handle 106 is an over-molded component that is secured to the proximal end portion 103 of the body 102 using fasteners. In yet other embodiments, the handle is omitted or has a reduced size such that the latch levers 108 are the primary or only component grasped by the user when drawing the charging handle 100 rearward to charge the action.

As can be seen in the bottom views of FIGS. 4-5, the body 102 defines a longitudinal channel 105 that is sized and configured so that the charging handle 100 can move forward or rearward over a protrusion 124 (FIGS. 6 and 7A, e.g.) on top of the lower receiver 50 or recoil assembly 60. The protrusion 124 is discussed in more detail below. When the latch lever(s) 108 is (are) pulled rearward (e.g., rearward against the handle 106), the latch 110 pivots to the side so that it is misaligned with the protrusion 124 and allows rearward movement of the charging handle 100 from the forward position.

Figure 6:
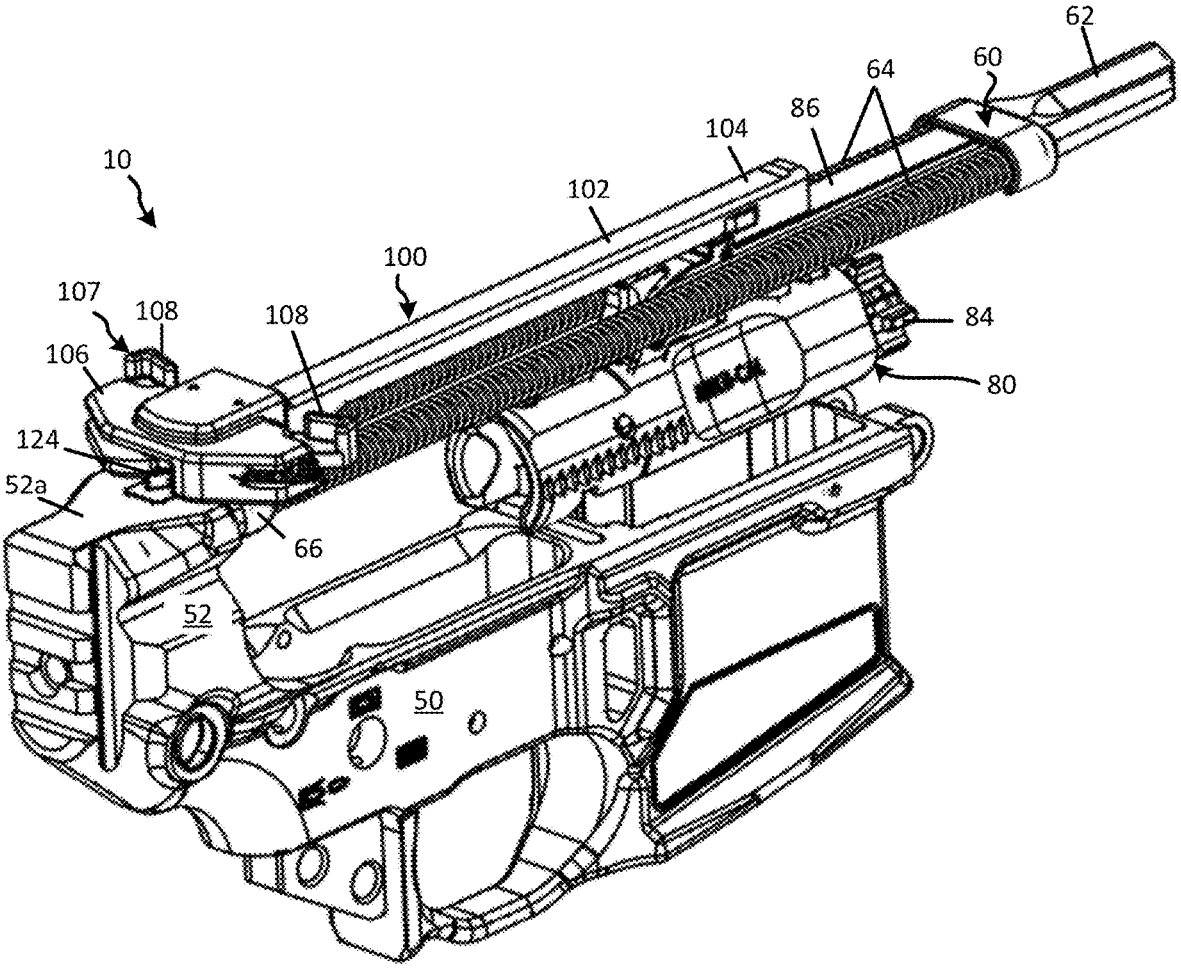
FIG. 6 is a top, rear, and side perspective view showing a charging handle together with a firearm lower receiver, a bolt assembly, and recoil assembly, in accordance with an embodiment of the present disclosure.

Referring now to FIG. 6, a perspective view illustrates top, rear, and sides of a firearm subassembly 10 that includes a charging handle 100, a firearm lower receiver 50, a bolt group 80, and recoil assembly 60, in accordance with an embodiment of the present disclosure. In this example, the bolt group 80 includes a bolt carrier 82 and a bolt 84 received in the distal end of the bolt carrier 82. The bolt 84 slides axially and rotates within the bolt carrier 82 as the action cycles, as will be appreciated. An interface 86 engages the top of the bolt carrier 82 and couples the bolt carrier 82 to the op-rod 62 and other components of the recoil assembly 60. The interface 86 connects the op rod 62 to the bolt group 80 and transfers force between recoil assembly 60 and the bolt group 80. In one example, the interface 86 is a pivoting interface that may be positioned toward a rear end of the op-rod 62.

The recoil assembly 60 includes the op-rod 62, which is attached between a gas block (not shown) and the interface 86. One or more recoil springs 64 are connected to the op-rod 62 and extend rearwardly to a rear end portion 52 of the lower receiver 50. As shown in this example, the recoil assembly 60 includes a pair of recoil springs 64 that are received in a spring receptacle 66 that is received by or attached to the rear end portion 52 of the lower receiver. For example, the spring receptacle 66 is constructed to receive ends of each recoil spring 64. In some embodiments, the spring receptacle 66 is received in a recess or socket defined in the rear end portion 52 of the lower receiver. In some embodiments, the top surface 66*a* of the spring receptacle 66 is substantially flush with the top surface 52*a* of the rear end portion 52 of the lower receiver 50. For example, the top surface 66*a* can be coplanar with the top surface 52*a* ±1 mm. A protrusion 124 may extend upward from the top surface 66*a* of the spring receptacle 66 and functions as a block for the charging handle 100, as will be discussed in more detail below.

In FIG. 6, the charging handle 100 is shown in the forward position with the locking mechanism in the latched position. In the forward position, the distal end portion 104 of the charging handle 100 engages an interface 86 between the op rod 62 and the bolt group 80. From the forward position, the charging handle 100 (and bolt group 80) can be drawn rearward a small amount (e.g., for a chamber check) or fully rearward (e.g., to charge the action), as will be appreciated. Due to the engagement between the distal end portion 104 and the recoil assembly 60, drawing the charging handle 100 rearward also draws the bolt group 80 rearward, such as to charge the action or to clear the chamber.

Figure 7A:
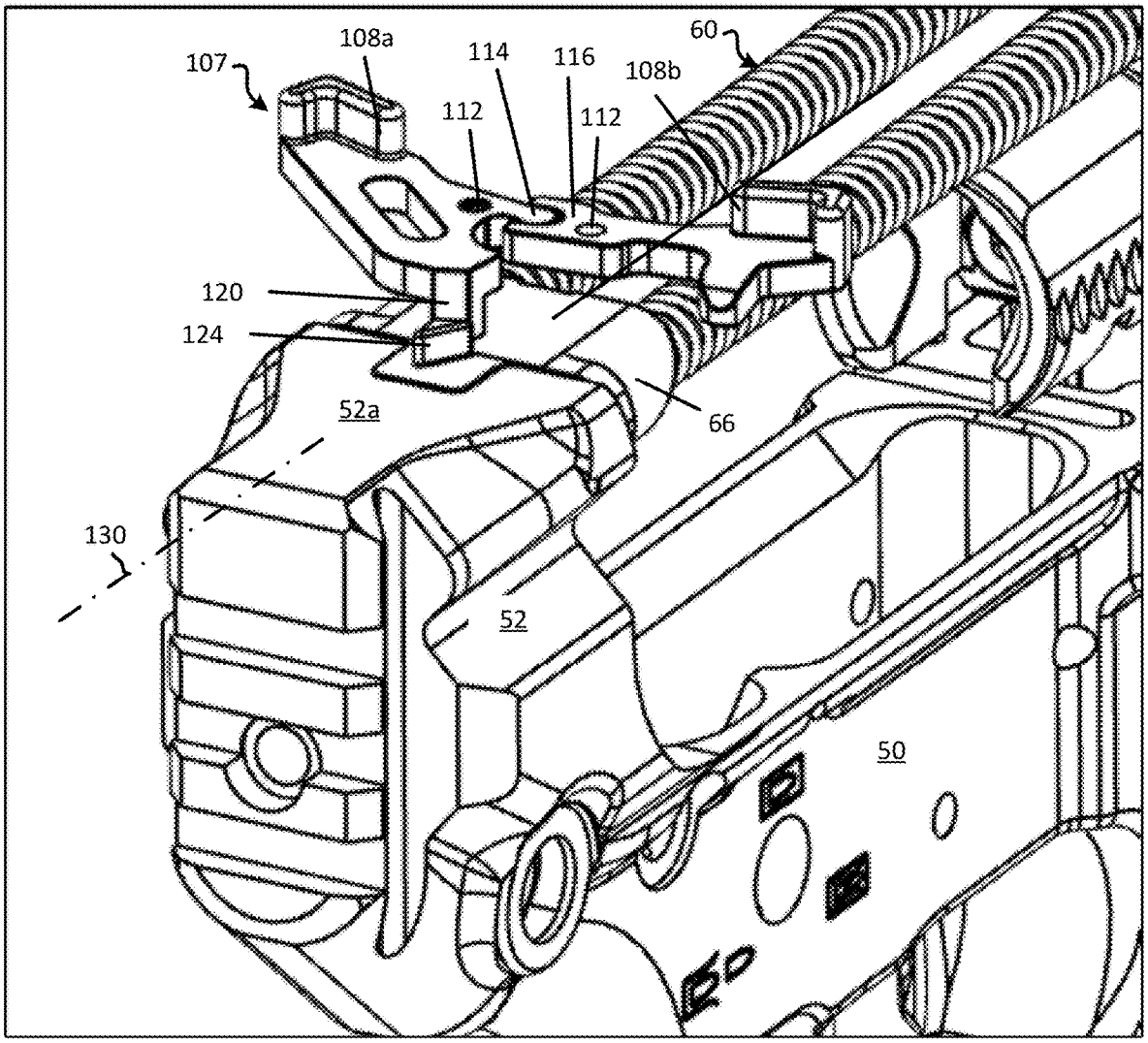
FIG. 7A is a top, rear, and side perspective view showing latch levers of a charging handle assembly in a latched position together with components of a rifle subassembly, in accordance with an embodiment of the present disclosure.
Figure 7B:
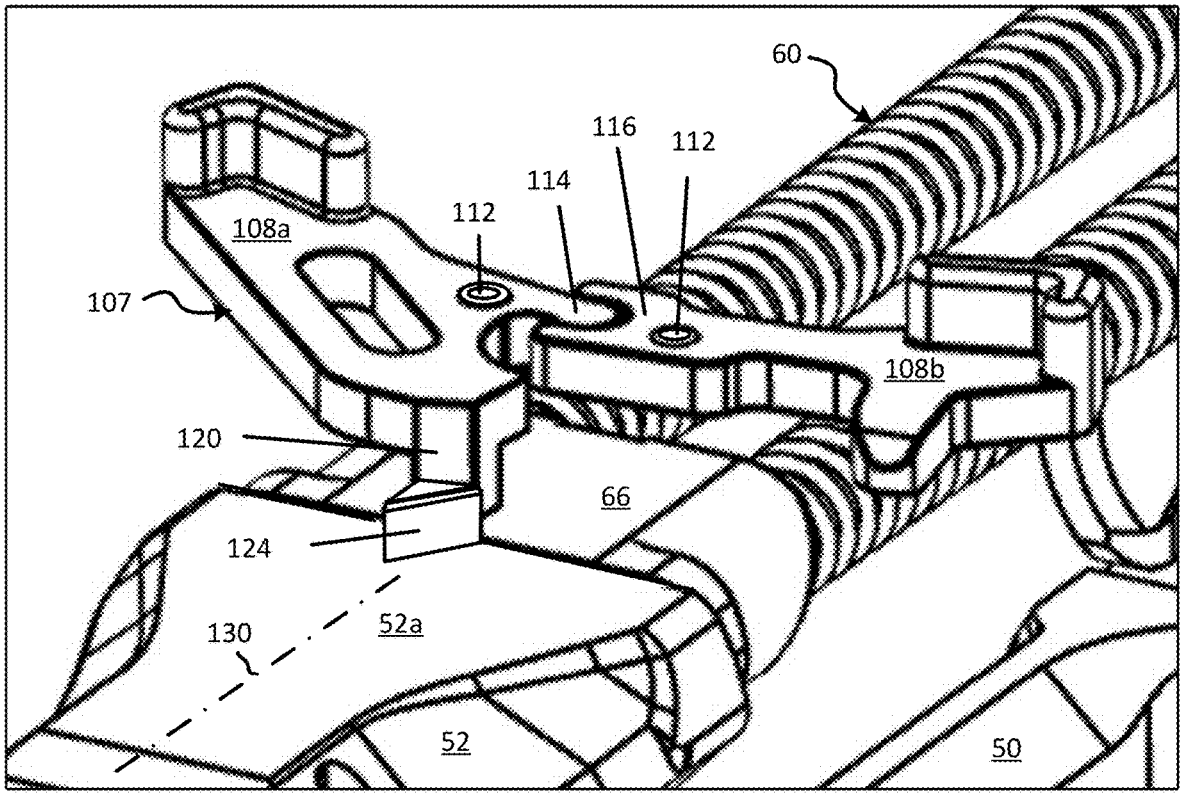
FIG. 7B is a top, rear, and side perspective view showing latch levers of a charging handle assembly in a latched position together with components of a rifle subassembly, in accordance with another embodiment of the present disclosure.

Referring to FIGS. 7A and 7B, rear perspective views show part of the latch assembly 107 in a latched position, together with portions of the lower receiver 50 and recoil assembly 60, in accordance with an embodiment. FIG. 7A shows an embodiment in which the protrusion 124 is on the spring receptacle 66 and FIG. 7B shows an embodiment in which the protrusion 124 is on the rear end portion 52 of the lower receiver 50. In FIGS. 7A-7B, the handle 106 and body 102 are omitted to more clearly show components of the latch assembly 107.

In these examples, the latch assembly 107 includes a left latch lever 108*a* and a right latch lever 108*b*. Each latch lever 108 extends laterally outward from the central axis 130 and can pivot about a corresponding pivot pin 112. In this example the pivot pins 112 are located on opposite sides of the central axis 130. The left latch lever 108*a* includes an arm 114 extending inward towards the right latch lever 108*b* from its pivot pin 112, and the right latch lever 108*b* includes a forked arm 116 extending inward towards the left latch lever 108*a* from its pivot pin 112. The forked arm 116 is shaped to receive an end of the arm 114 such that pivoting one of the latch levers 108 causes both latch levers 108 to pivot. In some embodiments, the charging handle 100 includes only one latch lever 108, such as including only the left latch lever 108*a*. Therefore, the second latch lever (e.g., right latch lever 108*b*) is omitted in some embodiments and therefore may be optional.

The left latch lever 108*a* has a blocking plate 120 that extends downward from the rear end portion of the latch lever 108. In the latched position as shown here, the blocking plate 120 is axially aligned with a protrusion 124 on the lower receiver 50 or recoil assembly 60. In FIG. 7A, the protrusion 124 is on the spring receptacle 66 received partially in the rear end portion 52 of the lower receiver 50. In FIG. 7B, the protrusion 124 is on the top surface 52*a* of the rear end portion 52 of the lower receiver 50. When the charging handle 100 is in the forward position and the blocking plate 120 is in the latched position, the protrusion 124 interferes with the blocking plate and obstructs moving the charging handle 100 rearward.

Figure 8:
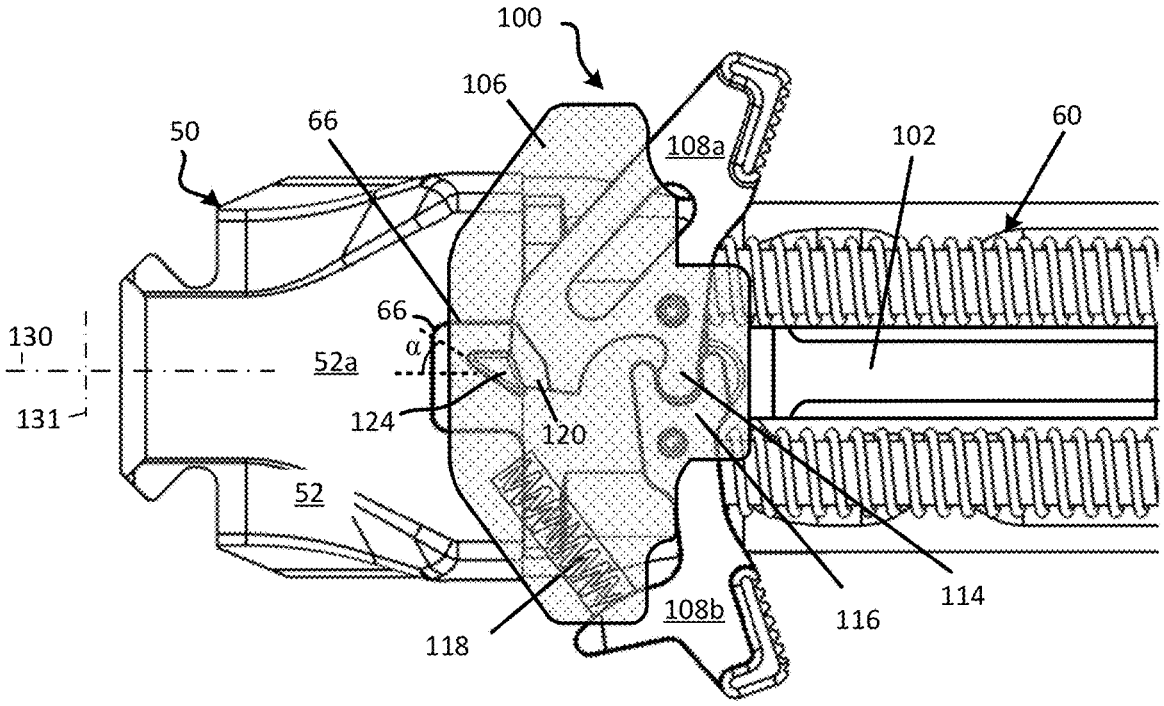
FIG. 8 is a top view of a rifle subassembly showing the latch levers of a charging handle in the latched position, in accordance with an embodiment of the present disclosure.

In FIG. 8, a top view shows the charging handle 100 with the latch levers 108 in the first (forward) position and the blocking plate 120 in the latched position. Here, the handle 106 is illustrated as transparent to more clearly show the components of the charging handle 100. A lever spring 118 biases the latch levers 108 forward to the first or forward position. In this example, the lever spring 118 extends between the handle 106 and part of the right latch lever 108*b*. The lever spring 118 exerts a spring force on the right latch lever 108*b*, urging the right latch lever 108*b* towards the first position (forward). The left latch lever 108*a* is also urged forward due to the interlocking engagement with the right latch lever 108*b*. When the latch levers 108 are in the forward position, the blocking plate 120 is axially aligned with the protrusion 124 and prevents the charging handle 100 from rearward movement. When the user pulls back on either latch lever 108, both latch levers 108 pivot about respective pivot pins 112 and move to the second position, causing the blocking plate 120 to move to an unlatched position at the side where it is not obstructed by the protrusion 124 and therefore allows the charging handle to be drawn rearward from its forward position.

Figure 9:
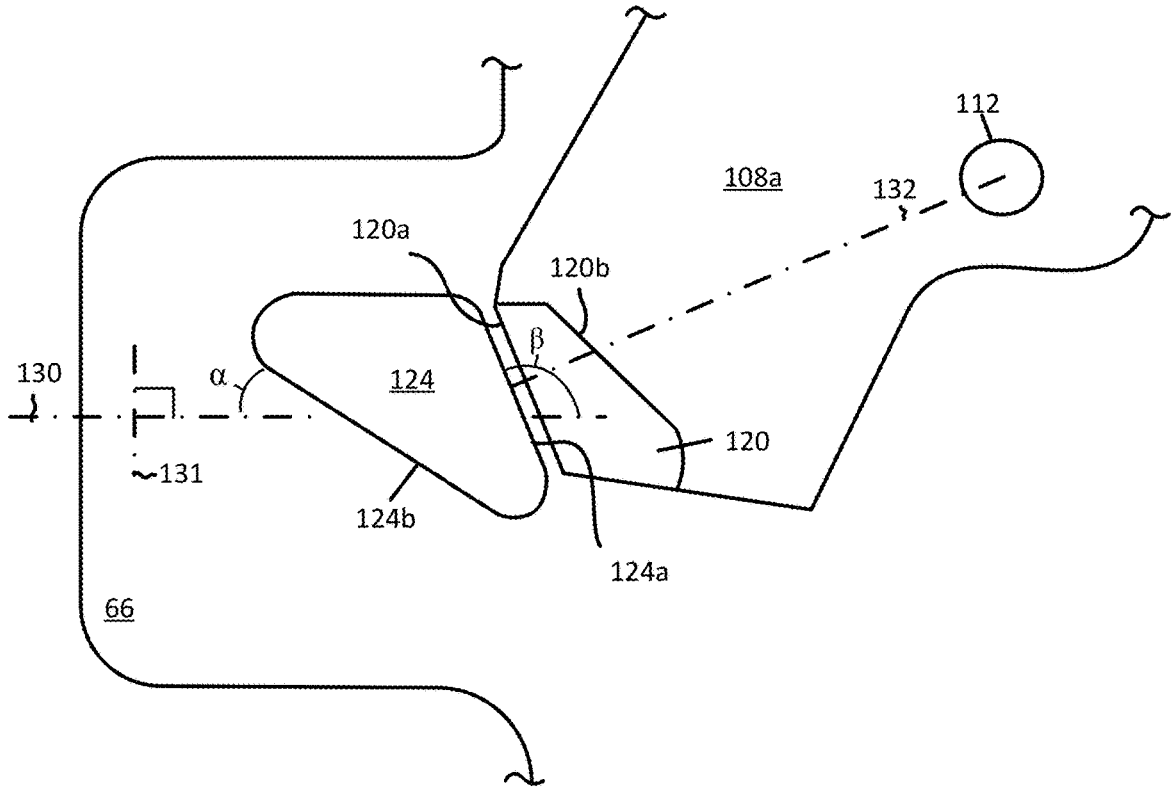
FIG. 9 is a top schematic diagram illustrating a protrusion on a spring receptacle and part of a latch lever of a charging handle assembly, in accordance with an embodiment of the present disclosure.

Referring to FIG. 9, a close-up top view diagrams part of the left latch lever 108*a* and protrusion 124, where the blocking plate is in the latched position, in accordance with one embodiment. The protrusion 124 has a cross-sectional shape of an obtuse isosceles triangle with one leg extending along the distal face 124*a*, another leg extending generally parallel to the central axis 130, and the base extending along a proximal face 124*b* that crosses the central axis 130. The proximal face 124*b* of the protrusion 124 functions as a cam surface when the charging handle 100 returns forward from a rearward position. For example, when the distal face 120*b* of the blocking plate 120 contacts the proximal face 124*b* of the protrusion 124 with sufficient forward momentum, the angled proximal face 124*b* of the protrusion 124 causes the left latch lever 108*a* to pivot about the pivot pin 112. In doing so, the blocking plate 120 moves to the side to a clearance position, allowing the charging handle 100 to proceed forward past the protrusion 124.

In one example, the proximal face 124*b* of the protrusion 124 defines an angle $\alpha$ of 20-40°, or about 30°, with respect to the central axis 130. The distal face 124*a* can extend perpendicularly to the central axis 130 or have a slight deviation from perpendicular. In some embodiments, such as shown in this example, the distal face 124*a* defines an angle $\beta$ from 90-120°, including 105-110°, with the central axis 130 (about 0-40° or about 15-20° with a crosswise axis 131). In some embodiments, angle $\beta$ is selected such that a force line 132 from the pivot pin 112 to the distal face 124*a* is perpendicular to the distal face 124*a*. With this configuration, recoil forces, or other impulse that causes the charging handle to move rearwardly against the protrusion 124, will not pivot of the latch levers 108 as could occur when the force line 132 between the distal face 124*a* and the pivot pin is at an angle other than 90°, as will be appreciated. Consistent with this arrangement, the proximal face 120*a* of the blocking plate 120 is parallel to the distal face 124*a* of the protrusion 124, in accordance with some embodiments. Numerous variations and embodiments will be apparent in light of the present disclosure.

Figure 10:
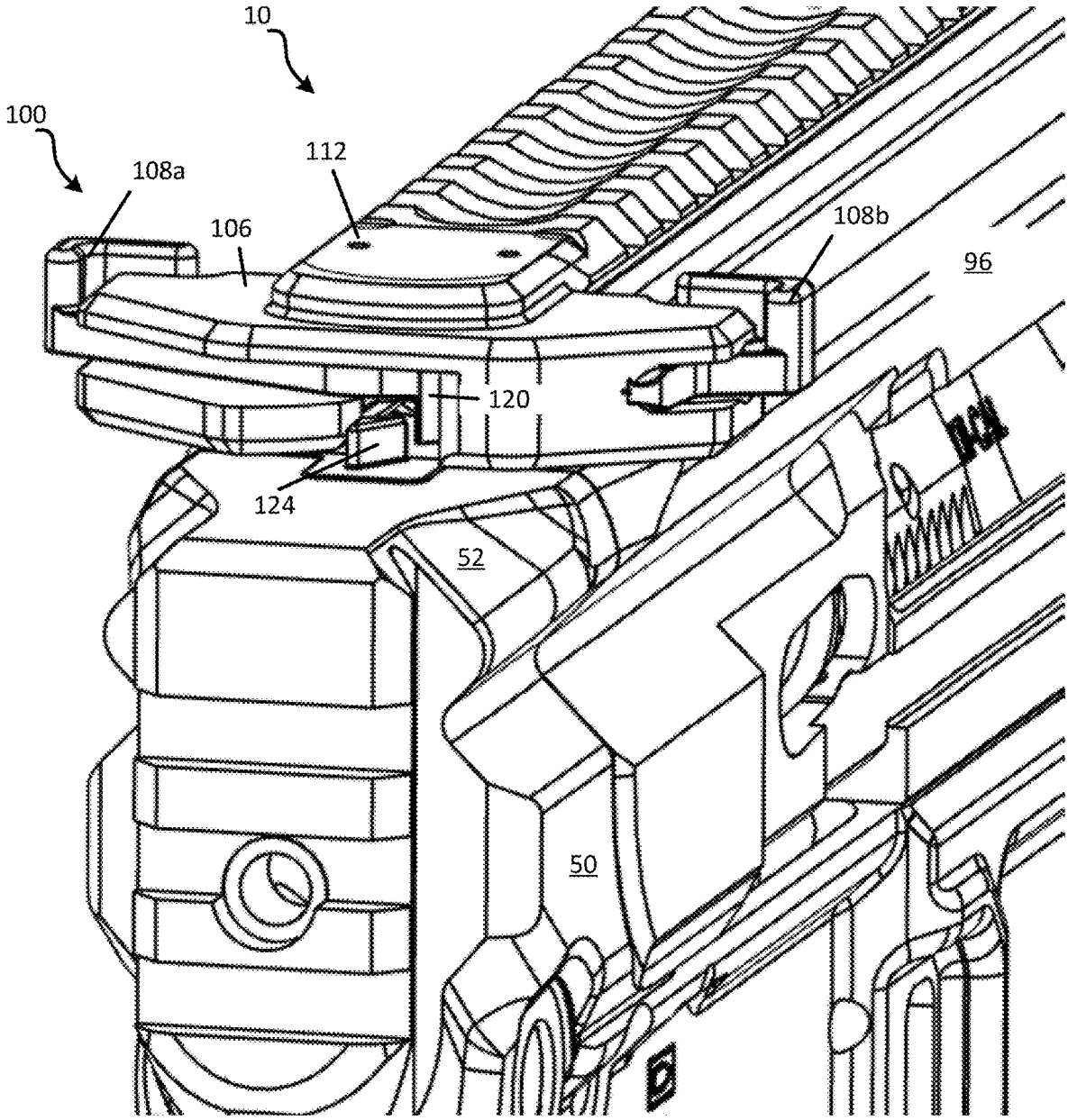
FIG. 10 is a top, rear, and side perspective view showing a charging handle as part of a rifle subassembly where the latch is in an unlatched position, in accordance with an embodiment of the present disclosure.
Figure 11:
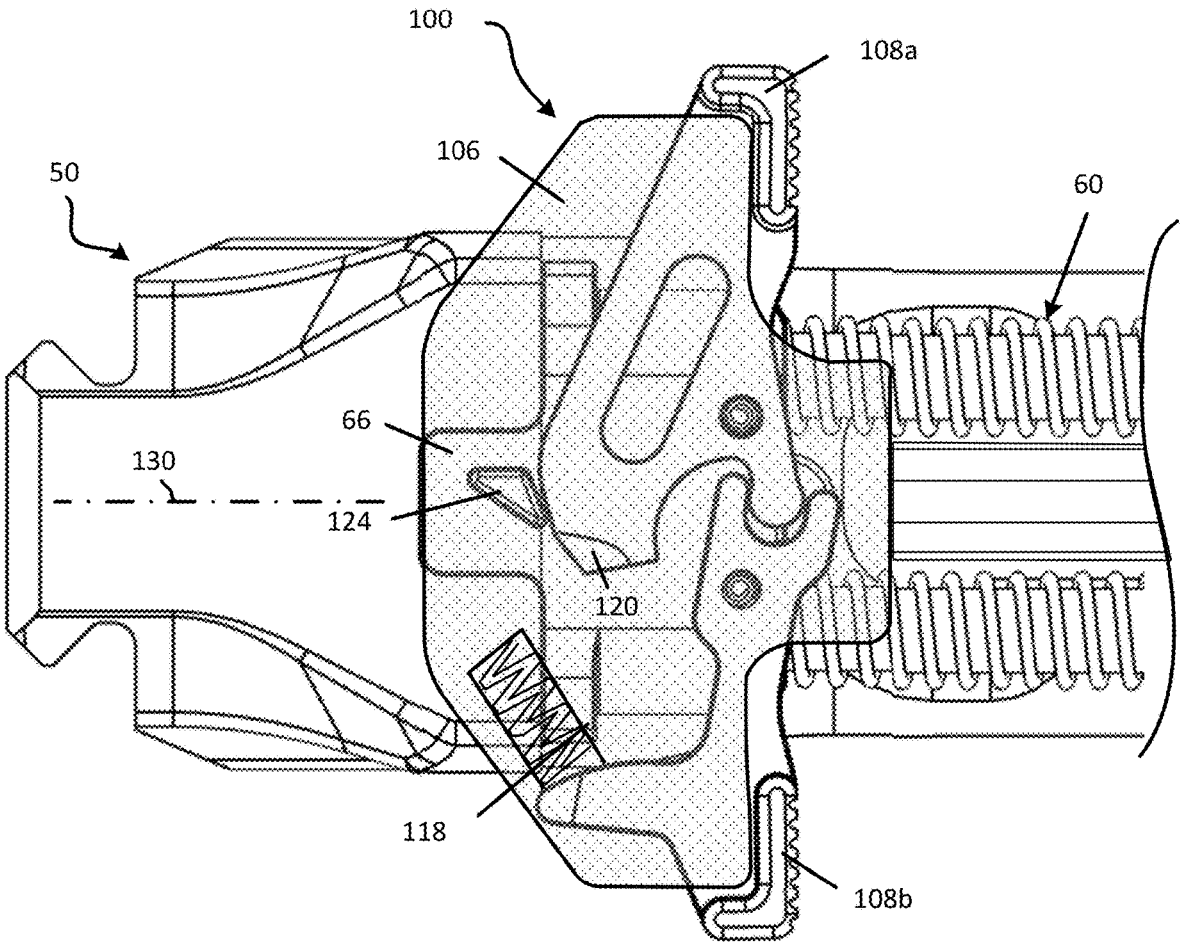
FIG. 11 is a top view showing portions of a charging handle assembly, lower receiver, and recoil assembly with the latch assembly in an unlatched position, in accordance with an embodiment of the present disclosure.

Referring now to FIG. 10, a rear perspective view shows part of a firearm subassembly 10 that includes a lower receiver 50, an upper receiver 96, and charging handle 100, in accordance with an embodiment of the present disclosure. FIG. 11 is a top view illustrating portions of the firearm subassembly 10 of FIG. 10, where the upper receiver 96 is omitted and the handle 106 is illustrated as transparent to more clearly show portions of the latch assembly 107. In this example, the left and right latch levers 108*a*, 108*b* have been pivoted rearward to the second position, compressing the lever spring 118. In the second position, the blocking plate 120 is in an unlatched position. In this example, the blocking plate 120 has pivoted to the side of the protrusion 124 where it is not aligned to contact the protrusion 124 when the charging handle 100 is drawn rearward along the central axis 130. In these examples, the blocking plate 120 has been moved to the right side of the protrusion 124 and the charging handle 100 is therefore not obstructed by the protrusion 124. In this unlatched position, the charging handle 100 can be drawn rearwardly past (e.g., over) the protrusion 124 to charge the rifle's action, for example.

Figure 12A:
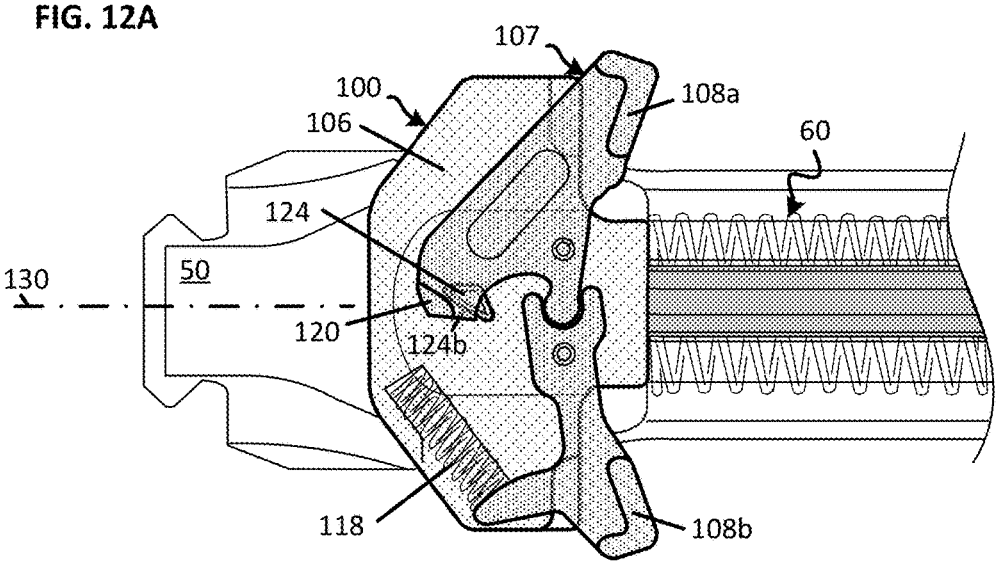
FIGS. 12A-12C illustrate top views showing portions of a charging handle assembly, lower receiver, and recoil assembly with the latch of the charging handle in various positions as the charging handle returns forward from a rearward position, in accordance with some embodiments of the present disclosure.
Figure 12B:
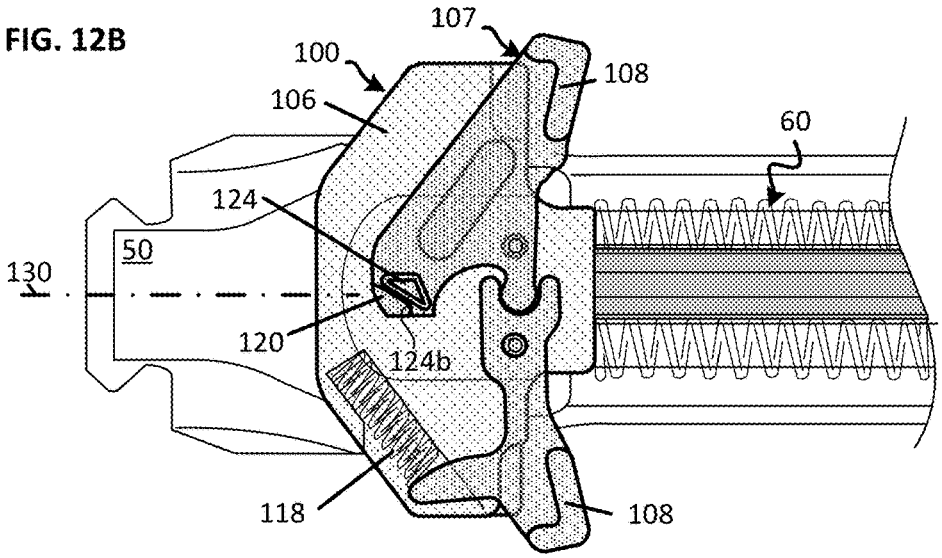
Figure 12C:
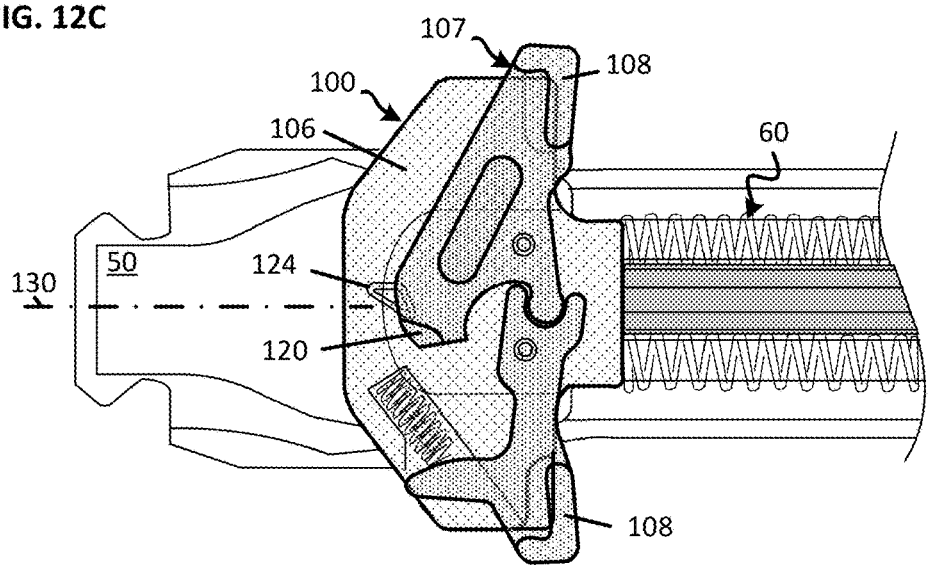

FIGS. 12A-12C illustrate top views showing portions of a charging handle 100, lower receiver 50, and recoil assembly 60. In this example, the latch assembly 107 is illustrated in various positions as the charging handle 100 returns forward over the protrusion 124 from a rearward position, in accordance with an embodiment. The handle 106 is illustrated as transparent to better show the latch assembly 107 and protrusion 124. As noted above, when the latch assembly 107 is in the latched position, the protrusion 124 is aligned with the blocking plate 120 to block rearward movement of the charging handle 100 from the forward position. As will be discussed in more detail below, the charging handle can move forward past the protrusion 124 due to the protrusion 124 camming the latch assembly 107 temporarily to the unlatched position as the charging handle 100 moves forward.

In FIG. 12A, the charging handle 100 has moved forward sufficiently from a rearward position so that the blocking plate 120 on the left latch lever 108*a* contacts the proximal face 124*b* of the protrusion 124. In this position, the lever spring 118 biases the latch levers 108 to the forward position. The blocking plate 120 is in the latched position where it is aligned along the central axis 130 with the protrusion 124. In this example, the central axis 130 is a central axis for both the charging handle 100 and the lower receiver 50. When the charging handle 100 is being driven forward by the recoil assembly 60, as is typical during normal operation, the charging handle 100 will have sufficient forward momentum such that the angled proximal face 124*b* of the protrusion 124 will function as a cam to pivot the blocking plate 120 to the side to the unlatched position as the charging handle 100 advances distally over the protrusion 124.

In FIG. 12B, the charging handle 100 has moved further distally along the central axis 130 with the blocking plate 120 in contact with the protrusion 124. In this position, the latch levers 108 have started to pivot against the force of the lever spring 118 towards the second position, and the blocking plate 120 has pivoted part way to the unlatched position. Note that the lever spring 118 is more compressed and that a majority of the blocking plate 120 surface contacts the proximal face 124*b* of the protrusion 124.

In FIG. 12C, the charging handle 100 has moved still further distally along the central axis 130 with the blocking plate 120 in contact with the protrusion 124. In this position, only a small portion of the blocking plate 120 contacts the protrusion 124. The blocking plate 120 is about to break from engagement with the protrusion 124 and will do so as the charging handle 100 continues to move forward and the blocking plate 120 moves laterally to clear the protrusion 124. Upon passing the protrusion 124, the latch levers 108 will return to the forward or first position (e.g., shown in FIG. 8) due to the bias provided by the lever spring 118. Note in FIG. 12C that the lever spring 118 is more compressed than it is in FIG. 12B since the latch levers 108 have been further pivoted towards the second position, and the blocking plate 120 is approaching the fully unlatched position.

Note that the charging handle 100 is shown in FIGS. 12A-12C as being aligned along the firearm's central axis 130, but this is not required. For example, the protrusion 124 and blocking plate 120 can be laterally offset from the central axis 130.

Figure 13:
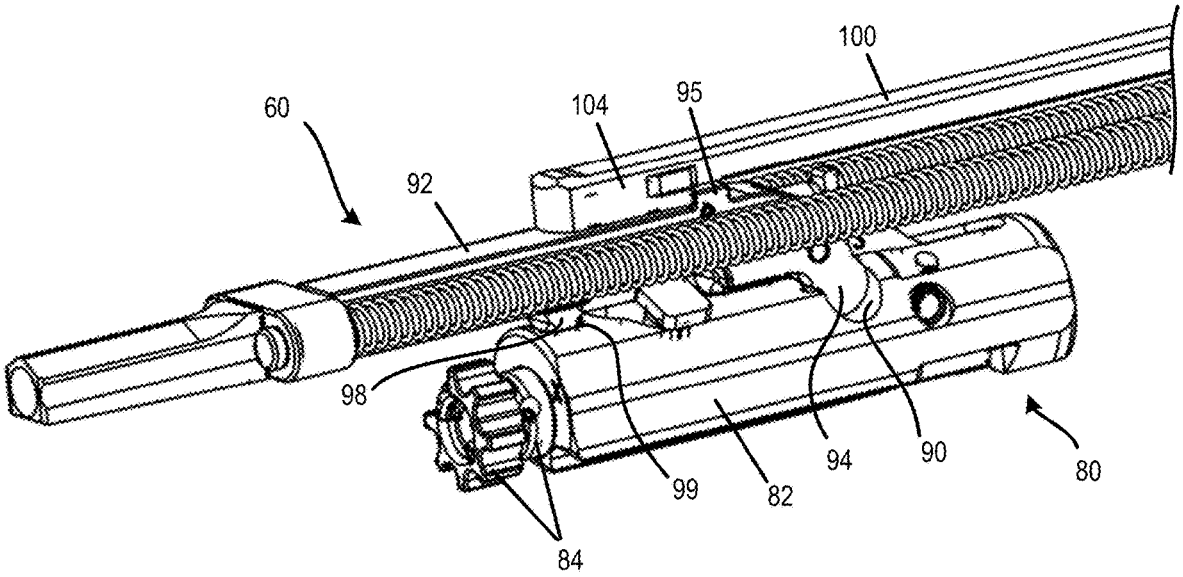
FIG. 13 is a front and side perspective view of a bolt group with an op-rod connector and part of a charging handle, in accordance with an embodiment of the present disclosure.

Referring now to FIG. 13, a top, front, and side perspective view illustrates components of a recoil assembly 60 and a bolt group 80, in accordance with an embodiment of the present disclosure. In this example, the bolt 84 is slidably and rotatably received in the bolt carrier 82. An op-rod connector 92 is connected to the bolt carrier 82 using a cylindrical joint along the top of the bolt carrier 82. For example, a rounded connector interface 94 is received in a transverse slot 90 in the bolt carrier 82. In this example, both the connector interface 94 and the transverse slot 90 have a cylindrical geometry such that the connector interface 94 is prevented from escaping the transverse slot 90 in an upward or forward direction, but instead can be removed by sliding the connector interface 94 sideways through the transverse slot 90. The cylindrical shape of the joint enables the op-rod connector 92 to pivot up or down with respect to the bolt carrier 82 during the recoil cycle. The op-rod connector 92 also engages the bolt carrier 82 with a forward protrusion 98 that is received in a forward recess 99 in the top, forward portion of the bolt carrier 82. In this example, the op-rod connector 92 has a rectangular protrusion 95 on its top surface for engagement with the distal end portion 104 of the charging handle 100. Using this engagement with the op-rod connector 92 and its connection to the bolt carrier 82, the charging handle 100 can be used to draw the bolt group 80 rearward along the upper receiver 96 to a rearward position.

Figure 14:
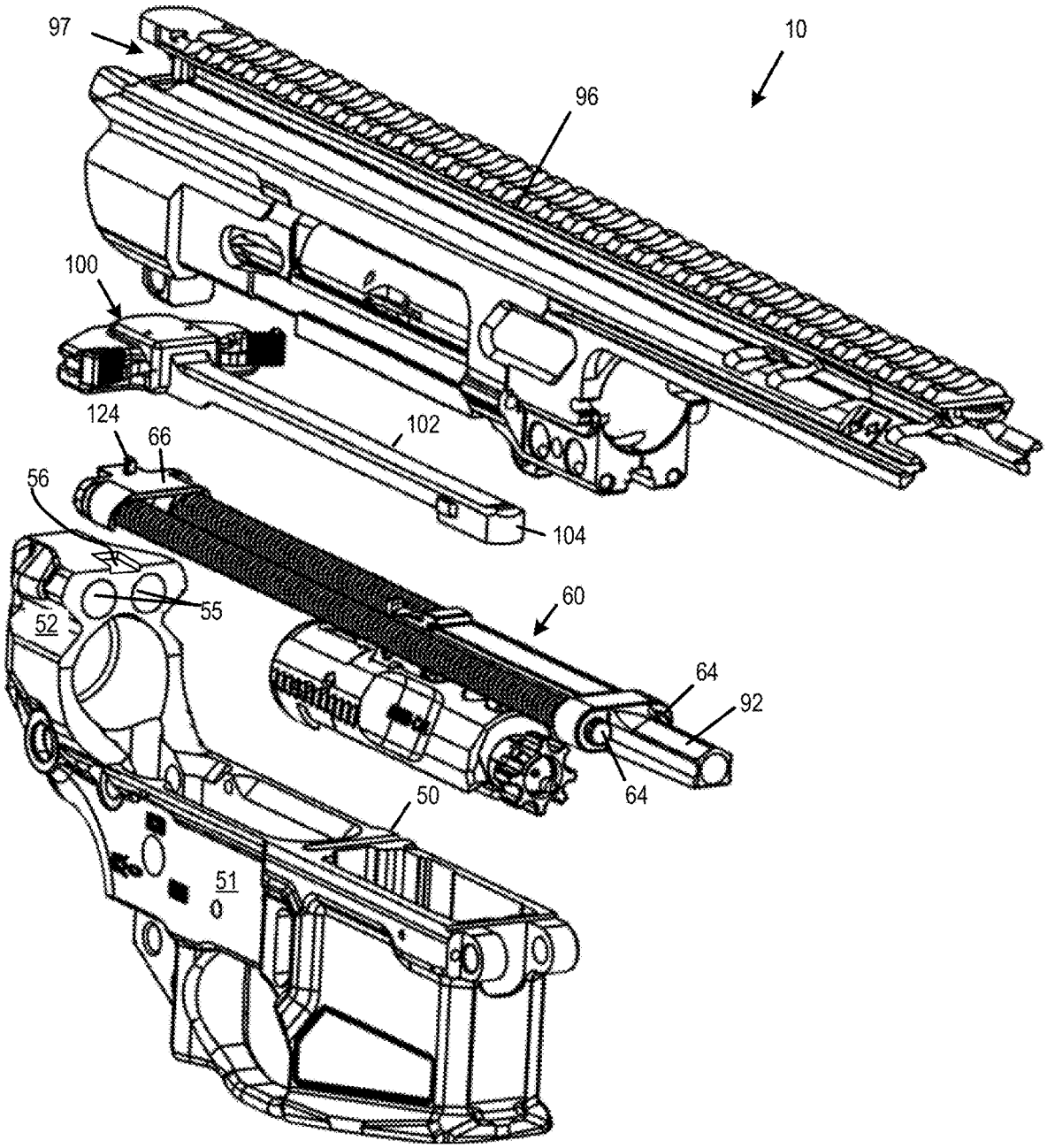
FIG. 14 is an exploded perspective view of a firearm subassembly that includes components of a lower receiver, an upper receiver, a recoil assembly with a bolt group, and a charging handle assembly, in accordance with an embodiment of the present disclosure.

FIG. 14 illustrates an exploded front and side perspective view showing components of a firearm subassembly 10, in accordance with one embodiment. In this example, the firearm subassembly 10 includes a lower receiver 50, an upper receiver 96, a recoil assembly 60, and charging handle 100. The upper receiver 96 can be assembled with the lower receiver 50 and extends over the receiver body 51. The recoil assembly 60 includes a spring receptacle 66 that engages the rear end portion 52 of the lower receiver 50. Recoil springs 64 extend between the spring receptacle 66 and the op-rod connector 92. A protrusion 124 extends up from the top of the spring receptacle 66 and functions to block rearward movement of the charging handle 100 in some positions, as discussed above. As also noted above, the protrusion 124 alternately could be on the top surface 52*a* of the rear end portion 52 of the lower receiver 50. The upper receiver 96 defines a charging handle passageway 97 for reciprocating sliding movement of the body 102 of the charging handle assembly 100. The charging handle passageway 97 communicates with portions of the upper receiver 96 that house the recoil assembly 60 so that the distal end portion 104 of the body 102 can engage the op-rod connector 92, as will be appreciated.

Figure 15A:
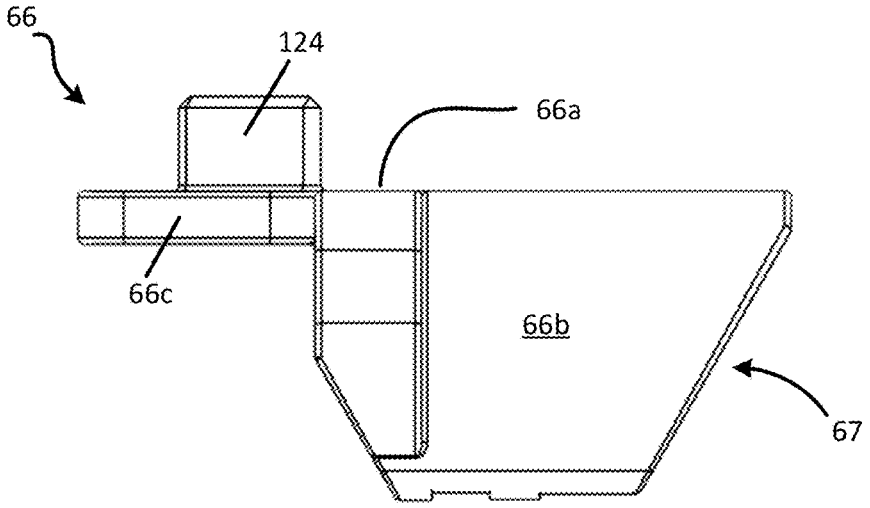
FIG. 15A is a side view of a spring receptacle, in accordance with an embodiment of the present disclosure.
Figure 15B:
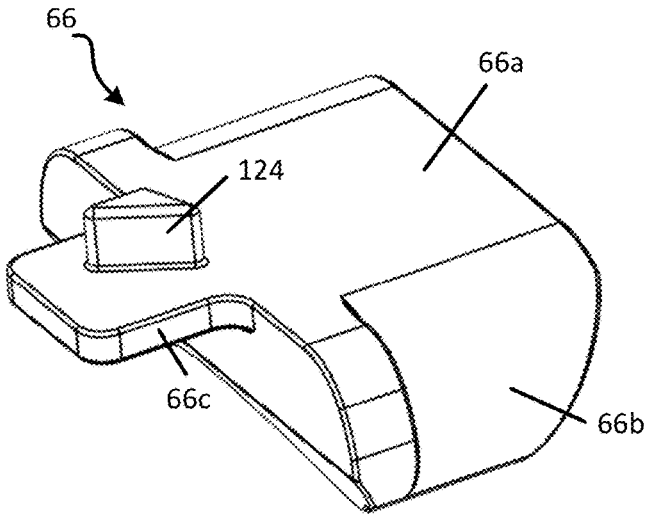
FIG. 15B is a top, side, and rear perspective view of the spring receptacle of FIG. 15A.
Figure 15C:
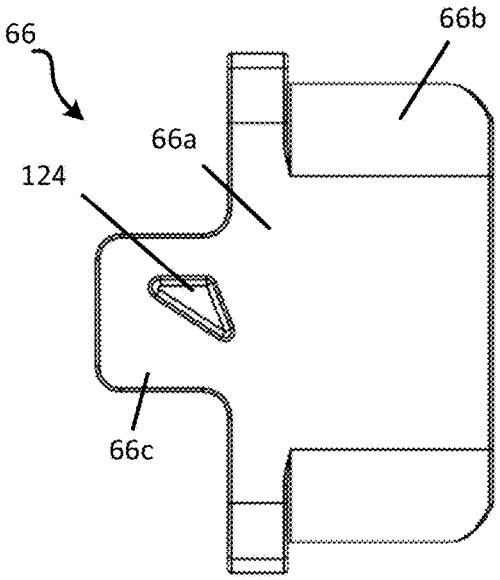
FIG. 15C is a top view of the spring receptacle of FIG. 15A.
Figure 15D:
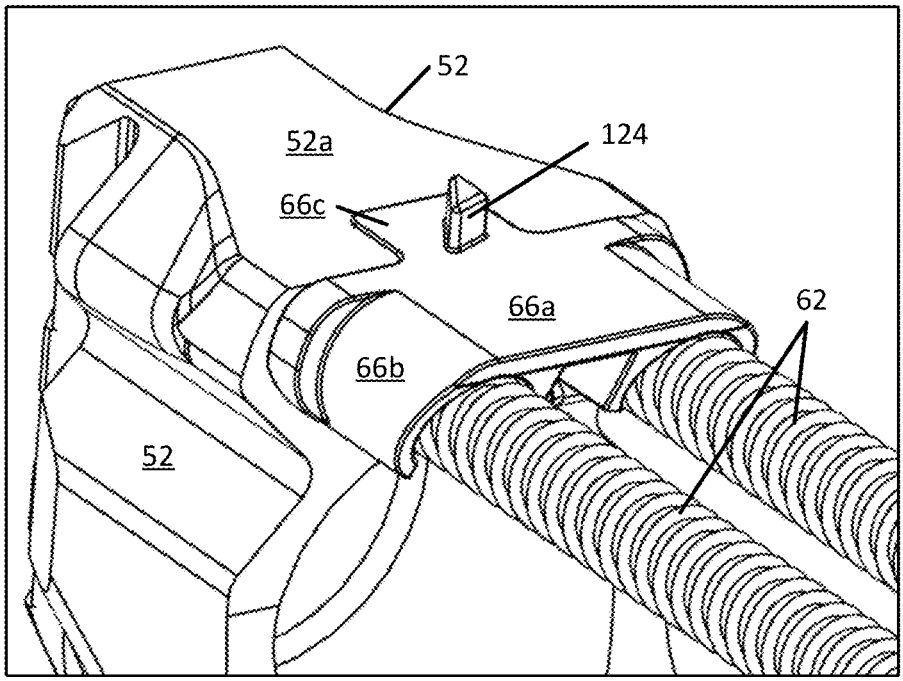
FIG. 15D is a top, side, and front perspective view showing the spring receptacle received in the rear end portion of a lower receiver and showing recoil springs received in the spring receptacle, in accordance with an embodiment of the present disclosure.
Figure 15E:
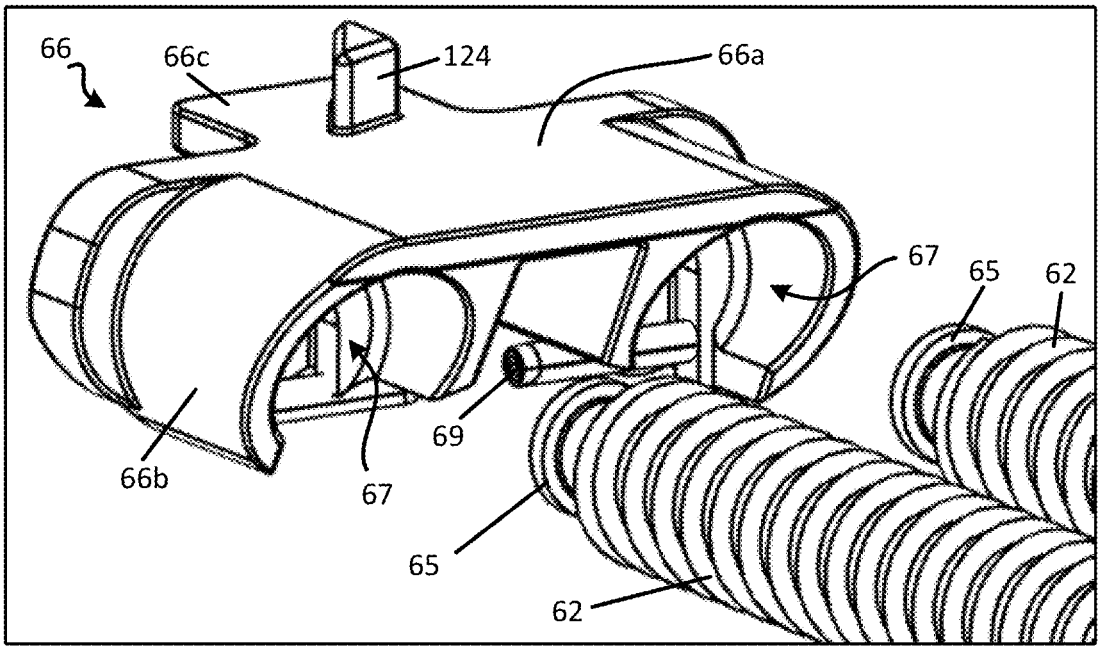
FIG. 15E is a top, front, and side perspective view showing a spring receptacle and portions of recoil springs, in accordance with an embodiment of the present disclosure.

Referring now to FIGS. 15A-15E, a spring receptacle 66 is illustrated in various views, in accordance with some embodiments. FIG. 15A is a side view, FIG. 15B is a rear perspective view, FIG. 15C is a top view, FIG. 15D is a front perspective view showing the spring receptacle assembled with the lower receiver 50, and FIG. 15E is a front perspective view showing the recoil springs 64 and guide rods 65.

In accordance with some embodiments, the spring receptacle 66 includes a body 66*b* defining a recess 67 for each guide rod 65. Each recess 67 can be generally cylindrical or can have some other suitable geometry for receiving an end of the guide rod 65. Each guide rod 65 can be retained in the recess 67 using a pin 69, fastener, or other suitable structure. In the example shown, the spring receptacle 66 defines two recesses 67, one for each guide rod 65 on opposite sides of the central axis 130. A top plate 66*c* extends rearward from the body 66*b* so that the top surface 66*a* is continuous along the body 66*b* and top plate 66*c*. The top plate 66*c* is configured to be received in a corresponding recess 56 defined in the lower receiver 50, such as shown in FIG. 14. In some such embodiments, the top surface 66*a* of the spring receptacle 66 simulates being part of the lower receiver 50. Body 66*b*, or part of it, can also received in a corresponding socket 55 in the rear end portion 52 of the lower receiver 50 in some embodiments. Spring receptacle 66 is constructed to assemble with the rear end portion 52 of the lower receiver 50 so that the top surface 66*a* of spring receptacle 66 is flush or substantially flush with the top surface 52*a* of the rear end portion 52 of the lower receiver 50, such as shown in FIG. 15D. For example, the spring receptacle 66 can be permanently, semi-permanently, or removably installed in the rear end portion 52 of the lower receiver using a snap fit, frictional fit, fasteners, welding, adhesive, or other suitable method. In some embodiments, protrusion 124 extends up from the top surface 66*a* of the top plate 66*c* and is positioned to engage the blocking plate 120, as discussed above.

Further Example Embodiments

The following examples pertain to further embodiments, from which numerous permutations and configurations will be apparent.

Example 1 is a charging handle assembly comprising a body extending longitudinally along a central axis, the body having a proximal end portion and a distal end portion. A latch lever connected to the proximal end portion of the body is operable between a first position and a second position. A blocking plate is movable between a latched position and an unlatched position in response to moving the latch lever from the first position to the second position.

Example 2 includes the subject matter of Example 1, wherein the blocking plate extends down from the latch lever.

Example 3 includes the subject matter of Example 2, wherein when the latch lever is in the first position, the blocking plate has a first lateral position, and when the latch lever is in the second position the blocking plate is displaced laterally to a second lateral position.

Example 4 includes the subject matter of any of Examples 1-3, wherein the latch lever pivots between the first position and the second position.

Example 5 includes the subject matter of any of Examples 1-3, wherein the latch lever moves linearly between the first position and the second position.

Example 6 includes the subject matter of any of Examples 1-5, where the latch lever is a first latch lever, and where the assembly further comprises a second latch lever operatively coupled to the first latch lever such that operation of either of the first or second latch levers moves the blocking plate between the first and second positions. In some such embodiments, only the first latch lever has a blocking plate.

Example 7 includes the subject matter of any of Examples 1-6, wherein the distal end of the body is constructed to engage a portion of a recoil assembly. For example, the distal end of the body engages a connector between the recoil spring(s) and the bolt assembly.

Example 8 includes the subject matter of any of Examples 1-7 and further comprises a handle on the proximal end portion of the body, the handle extending laterally from opposite sides of the body.

Example 9 includes the subject matter of any of Examples 1-8, wherein a bottom of the handle and the body define a longitudinal channel extending through the handle and along a portion of the body.

Example 10 includes the subject matter of any of Examples 1-9 and further comprises a firearm lower receiver, the lower receiver oriented along the central axis and having a rear end portion and a receiver body, the rear end portion extending upward from the receiver body; and a recoil assembly extending along the central axis above the receiver body, the recoil assembly including one or more springs with a spring plate on a proximal end, the spring receptacle coupled to the rear end portion of the lower receiver; wherein the distal end of the body of the charging handle is configured to engage the recoil assembly.

Example 11 includes the subject matter of Example 10 and further comprises a protrusion extending up from the spring receptacle or from the rear end portion of the lower receiver, wherein when the latch lever is in the first position the blocking plate aligns with the protrusion, and wherein when the latch lever is in the second position, the blocking plate is in a clearance position to a side of the protrusion.

Example 12 includes the subject matter of Example 11, wherein, when the latch lever is in the first position, the blocking plate is aligned to contact the protrusion, and when the latch lever is in the second position, the blocking plate is not aligned with the protrusion, thereby permitting axial movement of the charging handle along the central axis.

Example 13 includes the subject matter of any of Examples 10-12, wherein the protrusion extends up from the rear end portion of the lower receiver. For example, the protrusion extends up from a top surface of the rear end portion.

Example 14 includes the subject matter of any of Examples 10-12, wherein the protrusion extends up from the spring receptacle.

Example 15 includes the subject matter of any of Examples 11-14, wherein the protrusion has a proximal surface and a distal surface, the proximal surface extending transversely to the central axis and defining a proximal surface angle from 20 to 60 degrees.

Example 16 includes the subject matter of Example 15, wherein the proximal surface angle is from 30 to 45 degrees.

Example 17 includes the subject matter of any of Examples 11-16, wherein the distal surface defines a distal surface angle from 0-30 degrees with respect to a crosswise axis.

Example 18 includes the subject matter of Example 17, wherein the distal surface angle is from 0-20 degrees.

Example 19 includes the subject matter of Example 17, wherein the distal surface angle is from 0-10 degrees.

Example 20 includes the subject matter of any of Examples 1-19, wherein the blocking plate is positioned adjacent a rear portion of the handle.

Example 21 includes the subject matter of Example 20, wherein the blocking plate extends down from a rear end portion of the latch lever.

Example 22 is a firearm subassembly comprising a lower receiver oriented along a central axis, the lower receiver having a receiver body and a rear end portion extending upward from the receiver body; a recoil assembly extending over the receiver body and including one or more springs between an operating rod and a spring receptacle, the spring receptacle coupled to the rear end portion of the lower receiver; a protrusion extending up above a top surface of the rear end portion of the lower receiver; and a charging handle operably connected to the recoil assembly and constructed to reciprocate along the central axis, the charging handle comprising (i) a body extending longitudinally along the central axis, the body having a proximal end portion and a distal end portion, (ii) a latch lever on the attached to the proximal end portion of the body and operable between a first position and a second position, and the latch lever including a blocking plate extending down from the latch lever; wherein, when the latch lever is in the first position, the blocking plate is aligned along the central axis, and moving the latch lever to the second position moves blocking plate laterally to a clearance position with respect to the protrusion and thereby permitting axial movement of the charging handle without contacting the protrusion.

Example 23 includes the subject matter of Example 22, wherein the protrusion is part of the lower receiver.

Example 24 includes the subject matter of Example 23, wherein the protrusion is located in a channel defined along a top of the rear end portion of the lower receiver.

Example 25 includes the subject matter of Example 23, wherein the protrusion extends up from the top surface of the rear end portion of the lower receiver.

Example 26 includes the subject matter of Example 22 and further comprises a spring receptacle between the recoil assembly and the rear end portion of the lower receiver, the protrusion on a top surface of the spring receptacle.

Example 27 includes the subject matter of any of Examples 22-26, wherein the distal end portion of the charging handle engages the recoil assembly adjacent the operating rod.

Example 28 includes the subject matter of Example 27, wherein the recoil assembly includes a connector between the operating rod and the bolt assembly, the distal end portion of the charging handle engaging the connector.

Example 29 includes the subject matter of Example 28, wherein the connector has a rounded engagement interface for engaging the bolt carrier.

Example 30 includes the subject matter of any of Examples 22-29, wherein the protrusion has a proximal surface and a distal surface, the proximal surface extending transversely to the central axis and defining a proximal surface angle from 20 to 60 degrees. For example, the protrusion has a triangular cross-sectional shape.

Example 31 includes the subject matter of Example 30, wherein the proximal surface angle is from 30 to 45 degrees.

Example 32 includes the subject matter of any of Examples 30-31, wherein the distal surface extends transversely to the central axis and defines a distal surface angle from 90 to 105 degrees.

Example 33 includes the subject matter of Example 32, wherein the distal surface angle is from 90 to 100 degrees.

Example 34 includes the subject matter of Example 32, wherein the distal surface angle is from 90 to 95 degrees.

Example 35 includes the subject matter of any of Examples 22-34, wherein the blocking plate is positioned adjacent a rear portion of the handle.

Example 36 includes the subject matter of any of Examples 22-35, wherein the blocking plate extends down from a rear end portion of the latch lever.

Example 37 includes the subject matter of any of Examples 22-36, wherein a bottom of the charging handle defines a longitudinal channel sized to accommodate the protrusion.

Example 38 includes the subject matter of any of Examples 22-37, wherein the latch lever is a first latch lever and the charging handle further comprises a second latch lever, the first latch lever operably engaging the second latch lever such that operation of one of the first and second latch levers results in operation of the other of the first and second latch levers.

Example 39 includes the subject matter of Example 38, wherein the first latch lever extends laterally outward from a first side of the body of the charging handle and the second latch lever extends laterally outward from an opposite second side of the body of the charging handle.

Example 40 includes the subject matter of any of Examples 22-39 and further comprises an upper receiver attached to the lower receiver and extending over the receiver body; a bolt assembly slidably received in the upper receiver; wherein the recoil assembly is operably coupled to the bolt assembly.

Example 41 includes the subject matter of any of Examples 22-40, wherein the firearm is one of a semiautomatic rifle, an automatic rifle, a short-barreled rifle, a machine gun, a submachine gun, a carbine, or a pistol-caliber carbine.

The foregoing description of example embodiments has been presented for the purposes of illustration and description. It is not intended to be exhaustive or to limit the present disclosure to the precise forms disclosed. Many modifications and variations are possible in light of the present disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A charging handle assembly for a firearm, the charging handle assembly comprising:

a body extending longitudinally along a central axis, the body having a proximal end portion and a distal end portion;

a latch lever connected to the proximal end portion of the body and operable between a first position and a second position; and a blocking plate operably coupled to the latch lever, the blocking plate movable between a latched position and an unlatched position in response to moving the latch lever from the first position to the second position, wherein the blocking plate is on a rearward end portion of the latch lever and is configured to engage a protrusion on the firearm when the blocking plate is in the latched position.

2. The charging handle assembly of claim 1, wherein the latch lever pivots between the first position and the second position.

3. The charging handle assembly of claim 2, wherein when the latch lever is in the first position, the blocking plate has a first lateral position, and when the latch lever is moved to the second position the blocking plate is displaced laterally to a second lateral position.

4. The charging handle assembly of claim 3, wherein the blocking plate extends down from a rear end of the latch lever.

5. The charging handle assembly of claim 1, wherein the latch lever is a first latch lever, the charging handle assembly further comprising a second latch lever operatively coupled to the first latch lever such that operation of either of the first or second latch levers to the second position moves the blocking plate from the latched position to the unlatched position.

6. The charging handle assembly of claim 1 further comprising:

a handle on the proximal end portion of the body and extending laterally from opposite sides of the body.

7. The charging handle assembly of claim 6, wherein a bottom of the handle and the body define a longitudinal channel extending through the handle and along a portion of the body.

8. A charging handle assembly for a firearm, the charging handle assembly comprising:

a body extending longitudinally along a central axis, the body having a proximal end portion and a distal end portion;

a latch lever connected to the proximal end portion of the body and operable between a first position and a second position;

a blocking plate operably coupled to the latch lever, the blocking plate movable between a latched position and an unlatched position in response to moving the latch lever from the first position to the second position;

a firearm lower receiver, the lower receiver oriented along the central axis and having a rear end portion and a receiver body, the rear end portion extending upward from the receiver body; and a recoil assembly extending along the central axis above the receiver body, the recoil assembly including one or more springs with a spring receptacle on a proximal end, the spring receptacle coupled to the rear end portion of the lower receiver;

wherein the distal end portion of the body of the charging handle assembly is configured to engage the recoil assembly.

9. The charging handle assembly of claim 8 further comprising a protrusion extending up from the spring receptacle or from the rear end portion of the lower receiver, wherein when the blocking plate is in the latched position the blocking plate is axially aligned with the protrusion, and when the blocking plate is in the unlatched position the blocking plate is axially misaligned with the protrusion, thereby permitting rearward axial movement of the charging handle assembly along the central axis.

10. The charging handle assembly of claim 9, wherein the protrusion has a proximal surface and a distal surface, the proximal surface extending transversely to the central axis and defining a proximal surface angle from 20 to 60 degrees with the central axis.

11. The charging handle assembly of claim 10, wherein the distal surface of the protrusion defines a distal surface angle from 60 to 90 degrees with the central axis.

12. The charging handle assembly of claim 9, wherein the blocking plate is positioned adjacent a rear portion of the charging handle assembly.

13. A firearm subassembly comprising:

a lower receiver oriented along a central axis, the lower receiver having a receiver body and a rear end portion extending upward from the receiver body;

an upper receiver assembled with the lower receiver and extending along the central axis over the receiver body;

a recoil assembly at least partially housed in the upper receiver, the recoil assembly including one or more springs extending between an operating rod and the rear end portion of the lower receiver;

a protrusion extending up above a top surface of the rear end portion of the lower receiver; a charging handle comprising:

a body extending longitudinally along the central axis, the body having a proximal end portion and a distal end portion, the distal end portion configured to engage the recoil assembly; and a latch lever attached to the body and operable between a first position and a second position, the latch lever including a blocking plate extending down from the latch lever;

wherein, when the latch lever is in the first position, the blocking plate is axially aligned with the protrusion, and moving the latch lever to the second position moves the blocking plate laterally to a clearance position with respect to the protrusion, thereby permitting axial movement of the charging handle without contacting the protrusion.

14. The firearm subassembly of claim 13, wherein the protrusion is part of the lower receiver and extends up from the top surface of the rear end portion of the lower receiver.

15. The firearm subassembly of claim 13 further comprising a spring receptacle between the recoil assembly and the rear end portion of the lower receiver, the protrusion on a top surface of the spring receptacle.

16. The firearm subassembly of claim 13, wherein the protrusion has a triangular cross-sectional shape.

17. The firearm subassembly of claim 16, wherein the protrusion has a proximal surface and a distal surface, the proximal surface extending transversely to the central axis and defining a proximal surface angle from 20 to 60 degrees with the central axis.

18. The firearm subassembly of claim 17, wherein the distal surface extends transversely to the central axis and defines a distal surface angle from 90 to 105 degrees with the central axis.

19. The firearm subassembly of claim 18, wherein the blocking plate extends down from a rear end portion of the latch lever.

20. The firearm subassembly of claim 19, wherein a bottom of the charging handle defines a longitudinal channel sized to accommodate the protrusion.

* * * * *